US008081128B2

(12) United States Patent
Ueki

(10) Patent No.: US 8,081,128 B2
(45) Date of Patent: Dec. 20, 2011

(54) ANTENNA DEVICE AND WIRELESS COMMUNICATION APPARATUS

(75) Inventor: Noriyuki Ueki, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 256 days.

(21) Appl. No.: 12/614,494

(22) Filed: Nov. 9, 2009

(65) Prior Publication Data

US 2010/0045552 A1 Feb. 25, 2010

Related U.S. Application Data

(63) Continuation of application No. PCT/JP2008/054732, filed on Mar. 14, 2008.

(30) Foreign Application Priority Data

May 17, 2007 (JP) ..... 2007-131289

(51) Int. Cl.
*H01Q 9/00* (2006.01)

(52) U.S. Cl. ..... 343/745

(58) Field of Classification Search ..... 343/745, 343/702, 700 MS, 893, 767, 768–770
See application file for complete search history.

(56) References Cited

U.S. PATENT DOCUMENTS 5,353,035 A * 10/1994 Del Castillo Cuervo-Arango et al. ..... 343/700 MS
6,452,552 B1 * 9/2002 Ishitobi et al. ..... 343/700 MS
6,958,730 B2 * 10/2005 Nagumo et al. ..... 343/702
7,872,605 B2 * 1/2011 Baliarda et al. ..... 343/700 MS
7,965,252 B2 * 6/2011 Shtrom et al. ..... 343/795
2004/0196195 A1 10/2004 Yuanzhu

FOREIGN PATENT DOCUMENTS

JP 2001-168629 A 6/2001
JP 2004-312166 A 11/2004
JP 2006-148688 A 6/2006
JP 2006-287527 A 10/2006

OTHER PUBLICATIONS

Official Communication issued in International Patent Application No. PCT/JP2008/054732, mailed on Jun. 3, 2008.

* cited by examiner

*Primary Examiner* — Huedung Mancuso
(74) *Attorney, Agent, or Firm* — Keating & Bennett, LLP

(57) ABSTRACT

A multi-resonant antenna device having good VSWR characteristics even in the UWB band, and a wireless communication apparatus including the antenna device are provided. The antenna device includes a substrate, an antenna main body surface-mounted at a corner of the substrate, and slits. The antenna device resonates at two different resonance frequencies. The slits are arranged to bring a VSWR value at a frequency between the two resonance frequencies closer to VSWR values at the two resonance frequencies. The slits include capacitive adjustment slit portions and inductive adjustment slit portions. The slits are provided in an area where the density of a current flowing on ground conductor surfaces is highest. The slits are arranged perpendicularly or substantially perpendicularly to a direction of this current. Specifically, the slits are provided near and parallel or substantially parallel to an open end of the radiating electrode portion. The lengths of the slits are set to one-eighth of a wavelength at a frequency corresponding to the highest VSWR value in the range between the two resonance frequencies.

10 Claims, 17 Drawing Sheets

ANTENNA DEVICE AND WIRELESS COMMUNICATION APPARATUS

BACKGROUND OF THE INVENTION

1. Field of the Invention

The present invention relates to an antenna device included in a communication apparatus, such as a mobile phone, and a wireless communication apparatus including the antenna device.

2. Description of the Related Art

With recent development of small multi-functional communication apparatuses, such as mobile phones, there have been demands for smaller multi-resonant antenna devices included in such communication apparatuses. An example of an antenna device capable of meeting such demands is disclosed in Japanese Unexamined Patent Application Publication No. 2004-312166.

In this antenna device, a small radiating electrode plate having a feeding conductor plate connected to a feeding unit is disposed substantially parallel to a ground conductor surface, so that a small low-profile device is realized. Then, a pair of short-circuit conductor plates extending from outer edges of the radiating electrode plate is connected to the ground conductor surface. Thus, a first resonance mode based on one of the short-circuit conductors and a second resonance mode based on the other short-circuit conductor are obtained, so that a dual-resonant antenna device is realized.

However, the conventional antenna device described above has the following problems.

If the conventional antenna device described above is small in size, its voltage standing wave ratio (VSWR) tends to be very high at a frequency between two resonance frequencies. As a solution to this, it may be possible to form a matching circuit including chip components such as inductors and capacitors, so as to reduce the VSWR at the frequency between the two resonance frequencies and bring it closer to VSWRs at the resonance frequencies. However, the chip components such as inductors and capacitors have self-resonance frequencies, which are low. Therefore, in an antenna device using high frequencies in the ultra-wideband (UWB) and having resonance frequencies as high as 3 GHz or more, it is difficult to form a desired matching circuit from chip components.

SUMMARY OF THE INVENTION

In view of the problems described above, preferred embodiments of the present invention provide a small multi-resonant antenna device having good VSWR characteristics even in the UWB band, and a wireless communication apparatus including the antenna device.

According to a preferred embodiment of the present invention, an antenna device includes a substrate having a ground conductor surface, and a surface-mounted antenna main body having a radiating electrode portion disposed above the ground conductor surface of the substrate and a feeding electrode portion extending from the radiating electrode portion and connected to a feeding unit. The antenna device resonates at two different resonance frequencies. At least one slit is provided in or near an area where a density of a current induced on the substrate through short-circuit electrodes of the antenna main body on the ground conductor surface and flowing during operation is highest. The at least one slit is arranged perpendicularly or substantially perpendicularly to a direction of this current. The at least one slit includes a capacitive adjustment slit portion having an open end that is open at an outer edge of the ground conductor surface, and a inductive adjustment slit portion having a first end that is connected to an end of the capacitive adjustment slit portion, the end being opposite the open end of the capacitive adjustment slit portion, and a second end that is closed.

With the structure described above, during antenna operation, a current flows in the antenna main body and the ground conductor surface of the substrate. The antenna main body and the ground conductor surface in which the current flows are excited and resonate at two resonance frequencies.

If the antenna main body is small in size, matching of the entire antenna device may not be able to be achieved, and the VSWR of the antenna device may be very high at a frequency between the two resonance frequencies. As a solution to this, it may be possible to achieve matching by forming a matching circuit including chip components, such as inductors and capacitors. However, the chip components have self-resonance frequencies, which are low. Therefore, when the antenna device uses high frequencies in the UWB, it is difficult to form a desired matching circuit capable of achieving desired matching.

However, in the antenna device according to a preferred embodiment of the present invention, the at least one slit is provided in or near an area where the density of a current induced on the substrate through short-circuit electrodes of the antenna main body on the ground conductor surface and flowing during operation is highest. Additionally, the slit is arranged perpendicularly or substantially perpendicularly to a direction of the current. Therefore, the slit is able to significantly impact the flow of the current. Moreover, the capacitive adjustment slit portion of the at least one slit generates capacitance between opposite inner edges of the ground conductor surface. Additionally, the inductive adjustment slit portion of the at least one slit causes the current to flow therearound along inner edges of the ground conductor surface, and thus generates inductance. Therefore, without being restricted by self-resonance frequencies, the impedance of the slit can be changed by varying the lengths and widths of the capacitive adjustment slit portion and the inductive adjustment slit portion. Even when high frequencies in the UWB are used, the impedance of the at least one slit can be appropriately adjusted and matching of the antenna device can be achieved such that a VSWR at a frequency between two resonance frequencies is brought closer to VSWRs at the two resonance frequencies.

The radiating electrode portion of the antenna main body preferably includes a radiating electrode plate disposed substantially parallel to the ground conductor surface of the substrate and having an outer edge from which the feeding electrode portion extends, and a plurality of short-circuit electrodes extending from different outer edges of the radiating electrode plate and connected to the ground conductor surface.

A pair of the short-circuit electrodes preferably extends from an extending position of the feeding electrode portion along an outer perimeter of the radiating electrode plate and is disposed at opposite positions facing each other; and an end of the radiating electrode plate located opposite the extending position of the feeding electrode portion, is an open end.

The antenna main body is preferably mounted at a corner of the substrate, with an open end of the radiating electrode plate being oriented in the longitudinal direction of the substrate; the slit is provided near the open end of the radiating electrode plate; and a length of the at least one slit extending from the open end of the capacitive adjustment slit portion to the second end of the inductive adjustment slit portion is preferably set to about one eighth of a wavelength at or near a frequency corresponding to the highest voltage standing wave ratio, the frequency being between the two resonance frequencies of the antenna main body.

The antenna main body is preferably mounted at a location other than a corner of the substrate, with an open end of the radiating electrode plate being oriented in the longitudinal direction of the substrate; the at least one slit is provided near the open end of the radiating electrode plate; a length of the slit extending from the open end of the capacitive adjustment slit portion to the second end of the inductive adjustment slit portion is preferably set to about one quarter of a wavelength at or near a frequency corresponding to the highest voltage standing wave ratio, the frequency being between the two resonance frequencies of the antenna main body.

It is also preferred that a dielectric is disposed inside the at least one slit.

With this structure, the length of the at least one slit can be reduced.

In addition, it is preferable that the capacitive adjustment slit portion has a meandering shape.

In this structure, in the ground conductor surface, opposite inner edges that define the capacitive adjustment slit portion are bent into shapes of comb teeth facing each other. This increases the distance of the facing inner edges of the ground conductor surface. Accordingly, the capacitive adjustment slit portion can be increased in capacitance and reduced in length.

The inductive adjustment slit portion preferably has a sawtooth shape.

In this structure, in the ground conductor surface, one of inner edges that define the inductive adjustment slit portion is bent several times. This increases the distance of the path of current flowing internally along the ground conductor surface. Accordingly, the inductive adjustment slit portion can be increased in inductance and reduced in length.

A wireless communication apparatus according to another preferred embodiment of the present invention includes the antenna device according to one of the preferred embodiments of the present invention described above.

As described in detail above, various preferred embodiments of the present invention achieve excellent effects in that it is possible to realize a small multi-resonant antenna device and provide good VSWR characteristics even in the UWB band.

In particular, according to a preferred embodiment of the present invention, the length of the at least one slit can be reduced.

In addition, according to another preferred embodiment of the present invention, the capacitive adjustment slit portion can be increased in capacitance and reduced in length.

Further, according to yet another preferred embodiment of the present invention, the inductive adjustment slit portion can be increased in inductance and reduced in length.

Additionally, the wireless communication apparatus according to a further preferred embodiment of the present invention makes it possible to realize a compact apparatus and achieve multi-resonant communication exhibiting good VSWR characteristics even in the UWB band.

Other features, elements, steps, characteristics and advantages of the present invention will become more apparent from the following detailed description of preferred embodiments of the present invention with reference to the attached drawings.

BRIEF DESCRIPTION OF THE PREFERRED EMBODIMENTS

DETAILED DESCRIPTION OF THE PREFERRED EMBODIMENTS

Hereinafter, preferred embodiments of the present invention will be described with reference to the drawings.

Preferred Embodiment 1

Figure 1:
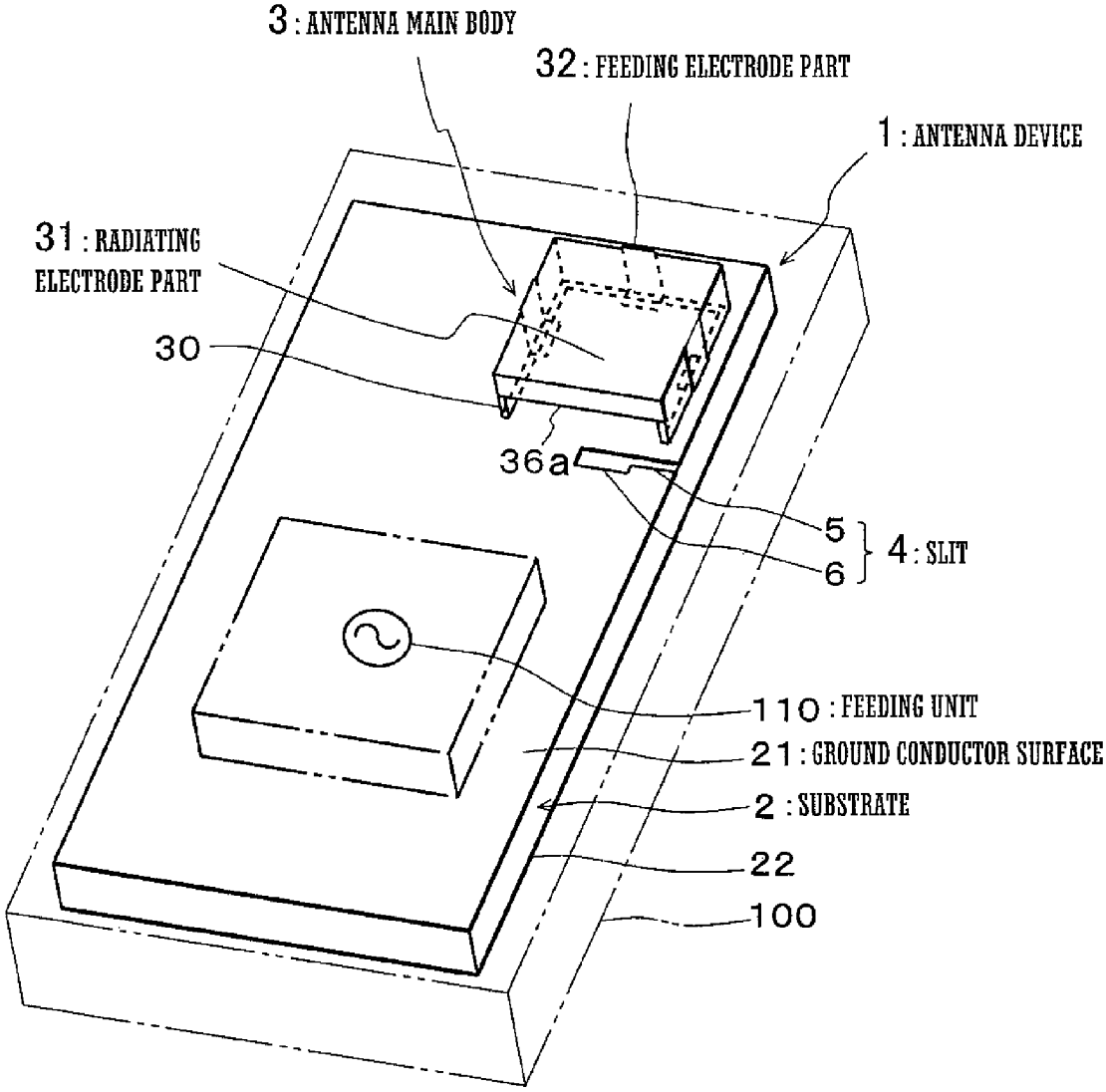
FIG. 1 is a schematic perspective view of an antenna device included in a wireless communication apparatus, according to a first preferred embodiment of the present invention.
Figure 2:
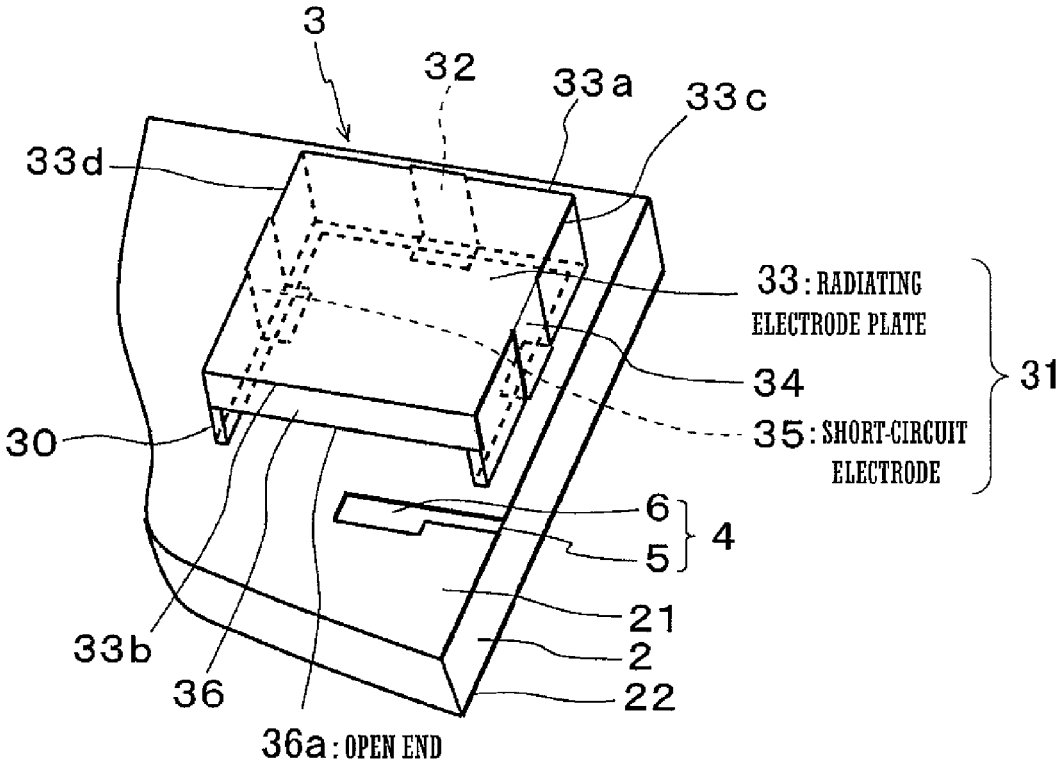
FIG. 2 is an enlarged perspective view of an antenna main body.

FIG. 1 is a schematic perspective view of an antenna device included in a wireless communication apparatus, according to a first preferred embodiment of the present invention. FIG. 2 is an enlarged perspective view of an antenna main body.

As illustrated in FIG. 1, the wireless communication apparatus is a mobile phone. An antenna device 1 according to the first preferred embodiment of the present invention is included in a housing 100 of the wireless communication apparatus. The wireless communication apparatus also includes other components, such as a keyboard, a microphone, a speaker, a liquid crystal panel, and various electronic circuits including a control unit, etc. These components will not be discussed or illustrated here, as they are known mechanisms. Hereinafter, only the antenna device 1 and its related mechanisms will be described.

The antenna device 1 includes a substrate 2, an antenna main body 3, and at least one slit 4.

The substrate 2 preferably is rectangular or substantially rectangular in shape. The substrate 2 has ground conductor surfaces 21 and 22 on its front and back sides, respectively.

The antenna main body 3 preferably is a rectangular-parallelepiped antenna element that is surface-mounted on the ground conductor surface 21 of the substrate 2. The antenna main body 3 includes a dielectric base 30, a radiating electrode portion 31 located on the dielectric base 30, and a feeding electrode portion 32 extending from the radiating electrode portion 31.

Specifically, as illustrated in FIG. 2, the radiating electrode portion 31 includes an radiating electrode plate 33 formed over the entire upper square surface of the dielectric base 30, and a pair of short-circuit electrodes 34 and 35 extending from outer edges of the radiating electrode plate 33.

The radiating electrode plate 33 is disposed substantially parallel to the ground conductor surface 21 of the substrate 2. The feeding electrode portion 32 extends from an outer edge 33*a* of the radiating electrode plate 33 toward the ground conductor surface 21. An end of the radiating electrode plate 33, the end being opposite an extending position from which the feeding electrode portion 32 extends, extends from an outer edge 33*b* of the radiating electrode plate 33 toward the ground conductor surface 21 to form an extending portion 36. An end of the extending portion 36 is an open end 36*a*. Thus, a capacitor C is formed between the open end 36*a* of the radiating electrode plate 33 and the ground conductor surface 21.

The pair of short-circuit electrodes 34 and 35 extends from outer edges 33*c* and 33*d*, respectively, of the radiating electrode plate 33 and is connected to the ground conductor surface 21. Thus, the pair of short-circuit electrodes 34 and 35 is located, in a short-circuited state, on the outer edges 33*c* and 33*d* and at respective positions facing each other. The outer edges 33*c* and 33*d* are opposite each other and extend from the extending position of the feeding electrode portion 32 along the outer perimeter of the radiating electrode plate 33.

The feeding electrode portion 32 extending from the radiating electrode portion 31 is not connected to the ground conductor surfaces 21 and 22, and is connected to a feeding unit 110, such as a transmitting/receiving unit, through a wire (not shown). The feeding unit 110 is grounded to the ground conductor surface 21 or the ground conductor surface 22.

As illustrated in FIG. 1, the antenna main body 3 is surface-mounted at the top right corner of the substrate 2, with the open end 36*a* of the radiating electrode plate 33 (radiating electrode portion 31) oriented in the longitudinal direction of the substrate 2 (i.e., in the downward direction in FIG. 1).

The above structure of the antenna main body 3 allows the antenna device 1 to resonate at two different resonance frequencies f1 and f2 regardless of whether there are the at least one slit 4 or a plurality of slits 4 provided.

Figure 3:
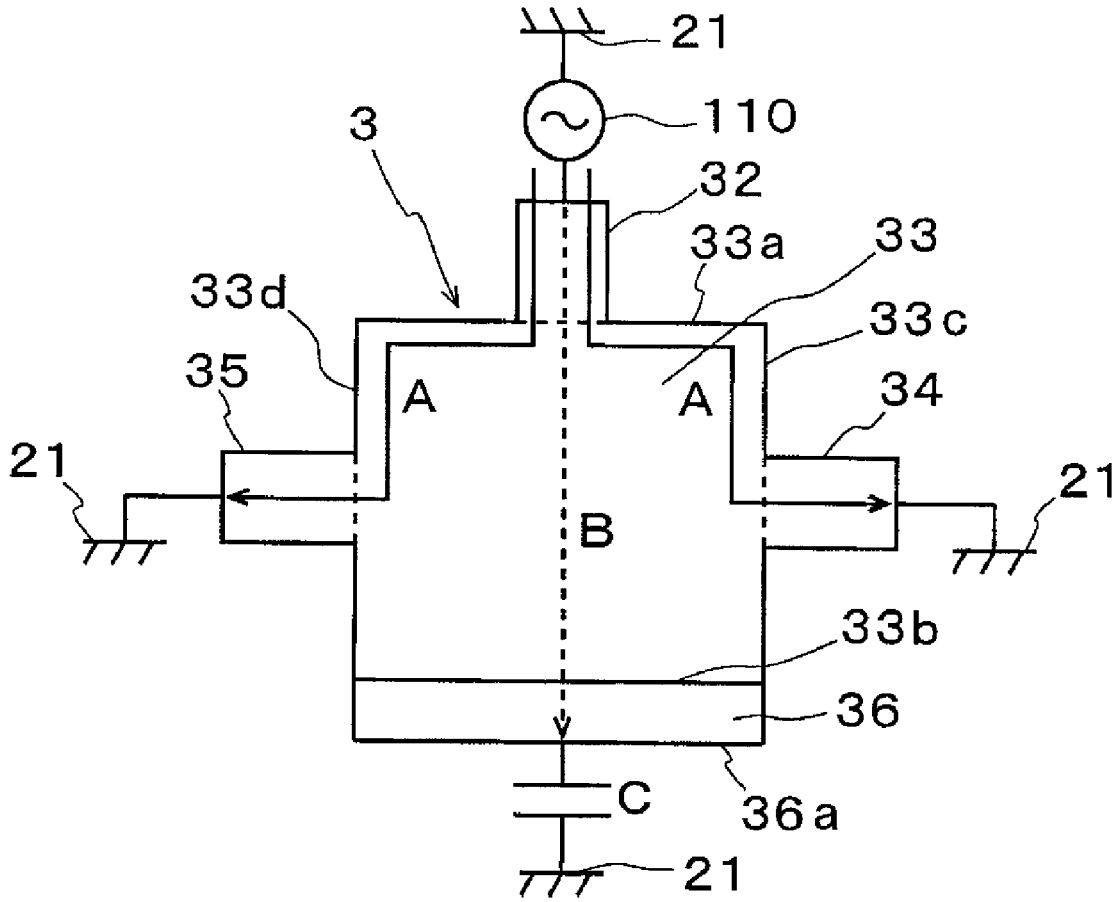
FIG. 3 is a schematic developed plan view illustrating the antenna main body to explain dual resonance characteristics of the antenna device.
Figure 4:
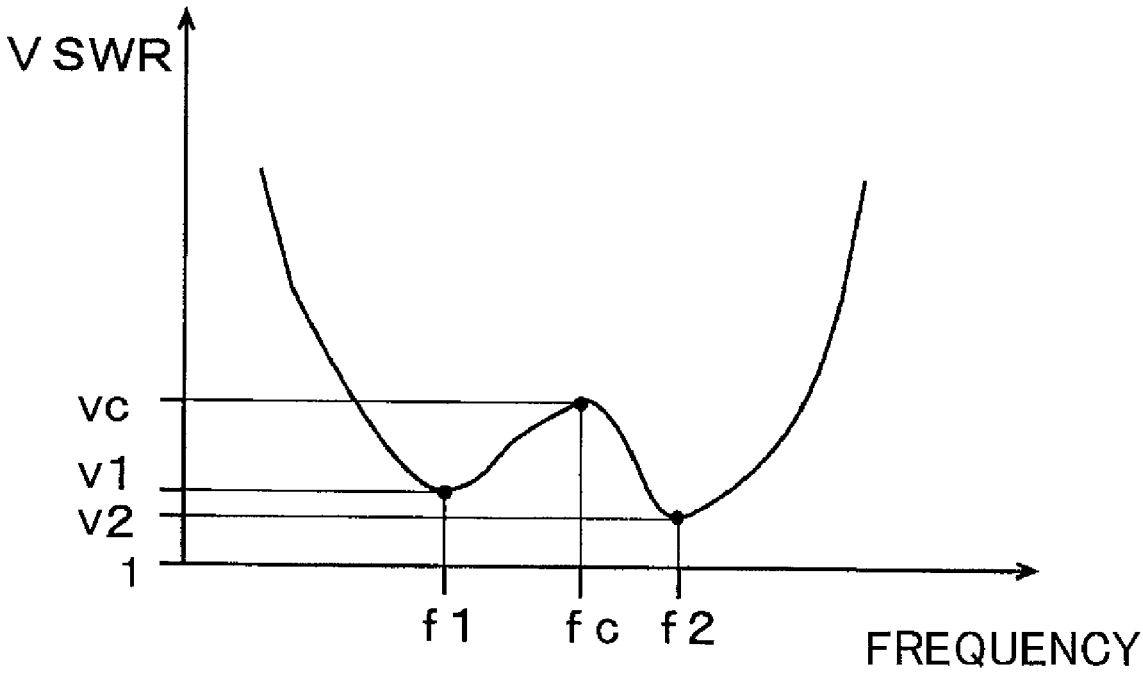
FIG. 4 is a VSWR characteristic diagram showing a dual resonance state.

FIG. 3 is a schematic developed plan view illustrating the antenna main body 3 to explain dual resonance characteristics of the antenna device. FIG. 4 is a VSWR characteristic diagram showing a dual resonance state.

As indicated by solid lines A in FIG. 3, a low-frequency current fed from the feeding unit 110 to the feeding electrode portion 32 of the antenna main body 3 passes through a corner of the radiating electrode plate 33, reaches the short-circuit electrode 34 (35), and flows out to the ground conductor surface 21.

In contrast, as indicated by dashed line B in FIG. 3, a high-frequency current fed from the feeding unit 110 to the feeding electrode portion 32 passes straight through the radiating electrode plate 33, over the capacitor C, and flows out to the ground conductor surface 21.

That is, the antenna device 1 functions as a monopole antenna or a loop antenna at the low resonance frequency f1, and functions as a patch antenna at the high resonance frequency f2. As a result, as shown in FIG. 4, the two resonance frequencies f1 and f2 corresponding to VSWR values close to "1" can be obtained. Thus, dual band communication can be performed using the wireless communication apparatus.

The slits 4 are a feature of the antenna device 1 of the present preferred embodiment and thus will be described in detail below.

Figure 5:
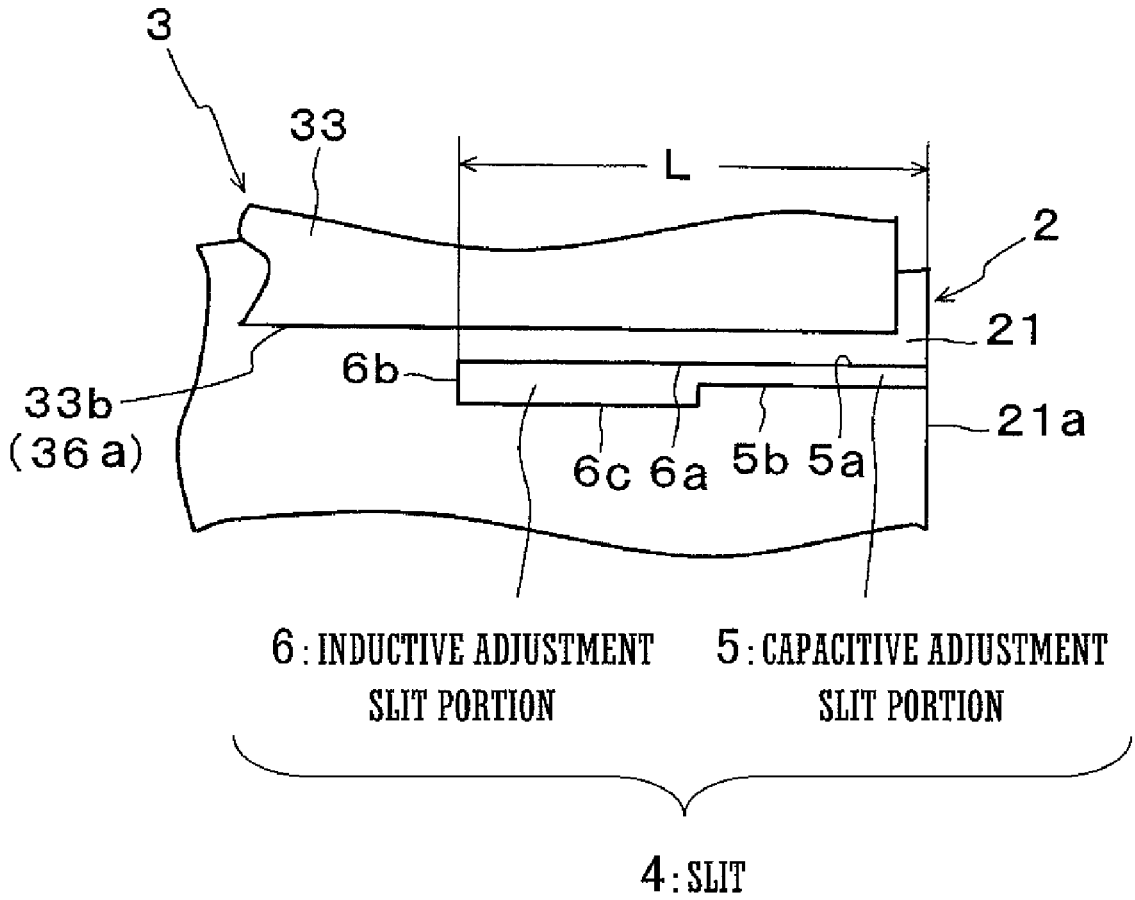
FIG. 5 is a partial enlarged plan view illustrating a slit.

FIG. 5 is a partial enlarged plan view illustrating the at least one slit 4.

The at least one slit 4, or a plurality of slits 4, is provided to achieve matching of the antenna device 1 such that a VSWR value at a frequency between the two resonance frequencies f1 and f2 shown in FIG. 4 is brought closer to VSWR values v1 and v2 at the two resonance frequencies f1 and f2. As illustrated in FIG. 5, the at least one slit 4 includes a capacitive adjustment slit portion 5 and an inductive adjustment slit portion 6 that are formed by cutting the ground conductor surfaces 21 and 22.

The capacitive adjustment slit portion 5 is a long narrow notch that is open at an outer edge 21*a* and 22*a* (22*a* is not shown in figures) of the ground conductor surfaces 21 and 22 of the substrate 2. The capacitive adjustment slit portion 5 has a capacitance value corresponding to its length and a distance between inner edges 5*a* and 5*b* that define the capacitive adjustment slit portion 5 in the ground conductor surfaces 21 and 22. In other words, the capacitance value can be adjusted by varying the length or the like of the capacitive adjustment slit portion 5.

The inductive adjustment slit portion 6 preferably is a long wide notch having a right end that is connected to a left end of the capacitive adjustment slit portion 5, and a left end that is closed. The inductive adjustment slit portion 6 has an inductance value corresponding to the length of inner edges 6*a*, 6*b*, and 6*c* that define the inductive adjustment slit portion 6 in the ground conductor surfaces 21 and 22. In other words, the inductance value can be adjusted by varying the length of the inductive adjustment slit portion 6.

In the ground conductor surfaces 21 and 22, the at least one slit 4 having the above structure are provided in or near an area where the density of a current that flows during operation of the antenna device 1 is highest. The at least one slit 4 is arranged perpendicularly or substantially perpendicularly to the direction of this current. Specifically, since the current density is highest near the short-circuit electrode 34 of the antenna main body 3, the at least one slit 4 is arranged perpendicularly or substantially perpendicularly to the longitudinal direction of the substrate 2, near the short-circuit electrode 34 of the radiating electrode portion 31 and the open end 36*a*, and parallel or substantially parallel to the edge of the open end 36*a*.

An overall length L of the slit 4 is preferably set to about one eighth of a wavelength at a frequency fc between the two resonance frequencies f1 and f2 shown in FIG. 4. The frequency fc corresponds to the highest VSWR value in the range between the two resonance frequencies f1 and f2.

Next, operations and effects of the antenna device 1 of the present preferred embodiment will be described.

Figure 6:
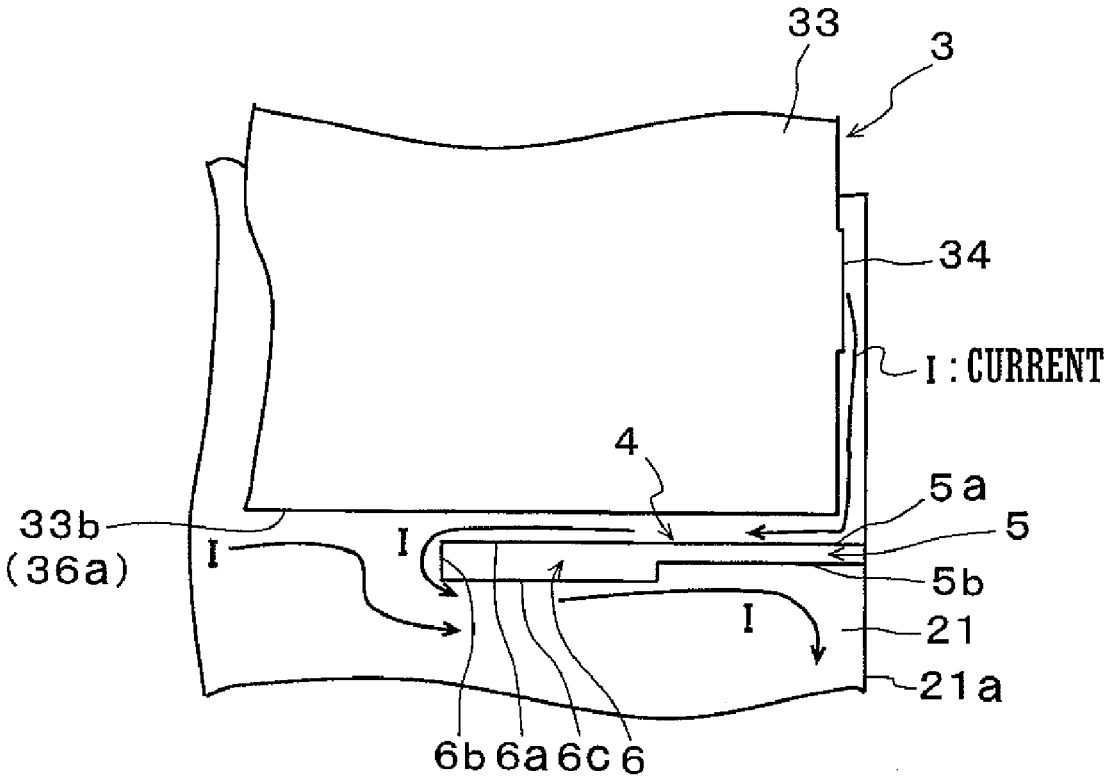
FIG. 6 is a partial enlarged plan view for explaining operations and effects of the antenna device.
Figure 7:
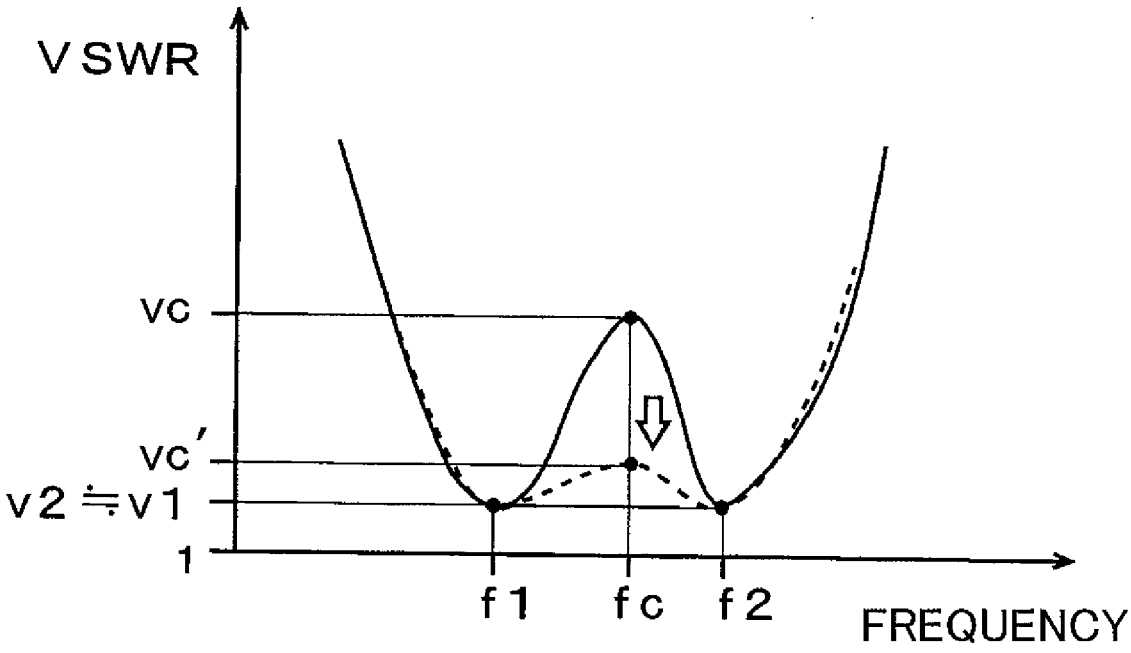
FIG. 7 is a VSWR characteristic diagram for explaining operations and effects of the antenna device.

FIG. 6 is a partial enlarged plan view for explaining operations and effects of the antenna device. FIG. 7 is a VSWR characteristic diagram for explaining operations and effects of the antenna device.

As illustrated in FIG. 3, when the antenna device 1 is operated at a low frequency, a current fed from the feeding unit 110 to the feeding electrode portion 32 of the antenna main body 3 passes through a corner of the radiating electrode plate 33, reaches the short-circuit electrode 34 (35), and flows out to the ground conductor surface 21. Then, at the low resonance frequency f1, the radiating electrode plate 33 and the short-circuit electrodes 34 and 35 of the antenna main body 3 and the ground conductor surface 21 are excited and allow the antenna device 1 to function as a monopole antenna or a loop antenna. When the antenna device 1 is operated at a high frequency, a current from the feeding unit 110 passes straight through the radiating electrode plate 33, over the capacitor C, and flows out to the ground conductor surface 21. Then, at the high resonance frequency f2, the radiating electrode plate 33 of the antenna main body 3 and the ground conductor surface 21 are excited and allow the antenna device 1 to function as a patch antenna. As a result, as shown in FIG. 7, the two resonance frequencies f1 and f2 corresponding to the VSWR values v1 and v2 close to "1" can be obtained.

When the antenna main body 3 is small in size, it is difficult to achieve matching of the antenna device 1. Therefore, as indicated by solid line in FIG. 7, a VSWR value vc at the frequency fc between the two resonance frequencies f1 and f2 becomes very high.

However, in the antenna device 1 of the present preferred embodiment, as illustrated in FIG. 5, the at least one slit 4 is arranged perpendicularly or substantially perpendicularly to the longitudinal direction of the substrate 2, near the short-circuit electrode 34 of the radiating electrode portion 31, and parallel or substantially parallel to the edge of the open end 36*a*. Then, in or near an area where the density of a current is highest, the at least one slit 4 is arranged perpendicularly or substantially perpendicularly to the direction of the current.

Thus, as illustrated in FIG. 6, a current I from the short-circuit electrodes 34 and 35 of the antenna main body 3 to the ground conductor surfaces 21 and 22, or a current I from the open end 36*a* of the radiating electrode plate 33 to the ground conductor surfaces 21 and 22 flows perpendicularly or substantially perpendicularly toward the at least one slit 4, and then further flows along the inner edges 5*a* and 5*b* of the capacitive adjustment slit portion 5 and the inner edges 6*a*, 6*b*, and 6*c* of the inductive adjustment slit portion 6. That is, the current I that flows from the antenna main body 3 out to the ground conductor surfaces 21 and 22 bypasses the inductive adjustment slit portion 6 of the at least one slit 4, and further flows toward the outer edge 21*a* and 22*a* (22*a* is not shown in figures) of the ground conductor surfaces 21 and 22.

During operation of the antenna main body 3, the capacitive adjustment slit portion 5 generates capacitance between the opposite inner edges 5*a* and 5*b* of the ground conductor surfaces 21 and 22.

As described above, the capacitive adjustment slit portion 5 and the inductive adjustment slit portion 6 of the at least one slit 4 are provided on the path of the current I. This significantly impacts the flow of the current I and changes the impedance of the antenna device 1. Therefore, by appropriately setting the lengths of the capacitive adjustment slit portion 5 and inductive adjustment slit portion 6 to adjust the impedance of the at least one slit 4, the VSWR value vc at the frequency fc between the two resonance frequencies f1 and f2 can be reduced.

In the present preferred embodiment, the overall length L of the at least one slit 4 is preferably set to about one eighth of a wavelength at the frequency fc. Therefore, as indicated by dashed line in FIG. 7, the VSWR value vc at the frequency fc can be reduced to vc', which is close to the VSWR values v1 and v2 at the two resonance frequencies f1 and f2, respectively.

The present inventor carried out the following experiment to confirm the effect described above.

Figure 8:
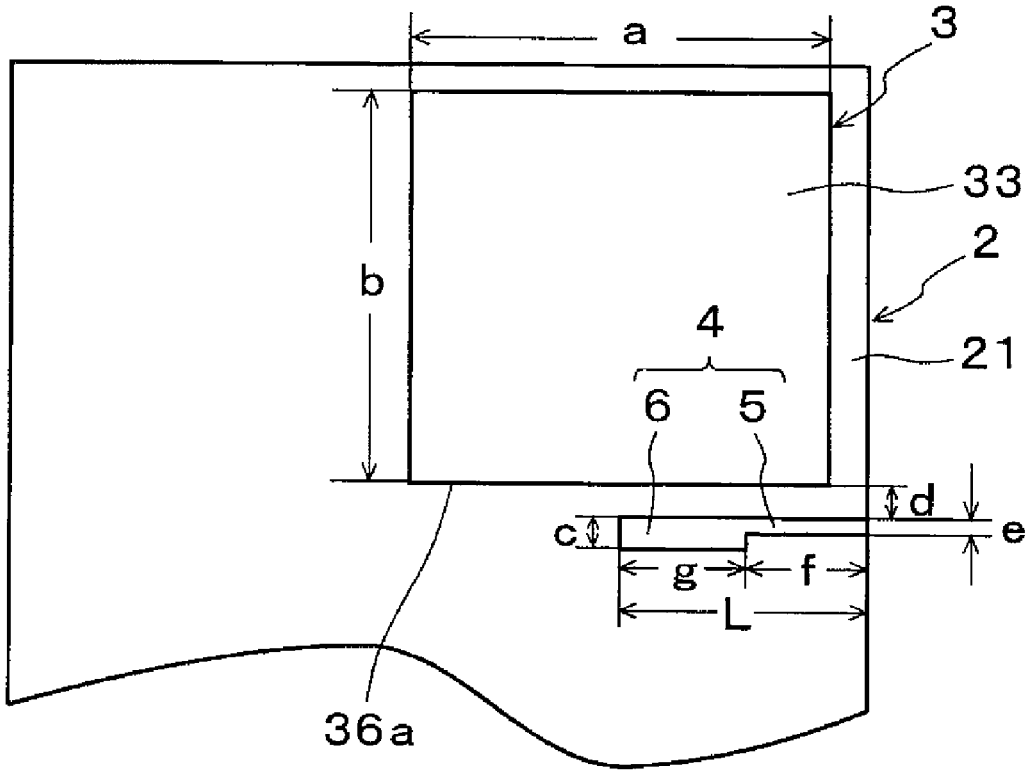
FIG. 8 is a plan view for explaining dimensions of the antenna main body, slit, etc.
Figure 9:
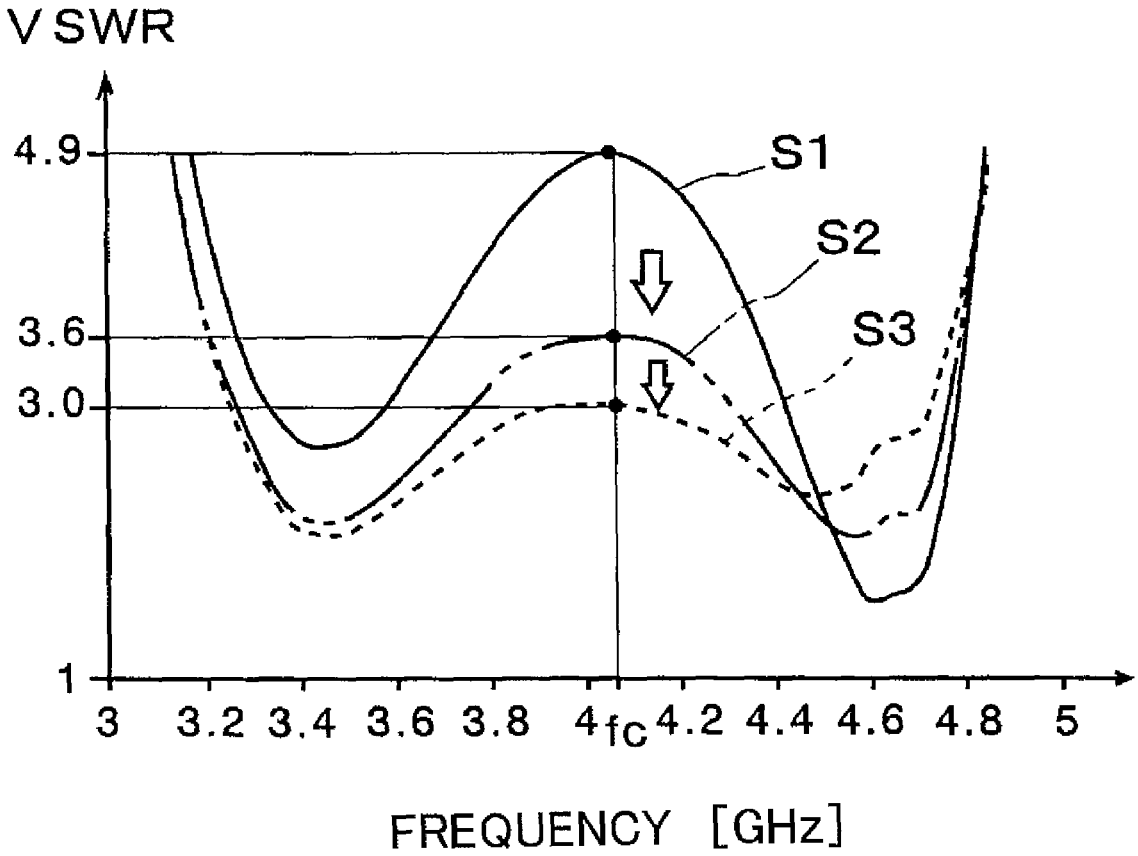
FIG. 9 is a VSWR characteristic diagram showing a result of an experiment.

FIG. 8 is a plan view for explaining dimensions of the antenna main body 3, the at least one slit 4, etc. FIG. 9 is a VSWR characteristic diagram showing a result of the experiment.

As illustrated in FIG. 8, in this non-limiting experiment, the antenna main body 3 measuring approximately 20 mm (a) by 20 mm (b) by 6.5 mm high was mounted at a corner of the substrate 2 measuring approximately 45 mm wide by 100 mm long. The dielectric base 30 of the antenna main body 3 had a relative permittivity of 6.45.

First, without providing the at least one slit or a plurality of slits 4, a current at a frequency of 3 GHz to 5 GHz was fed to the antenna main body 3, and a VSWR value at each frequency was measured. As indicated by solid line S1 in FIG. 9, this antenna device resonated at the resonance frequencies f1 and f2 of 3.45 GHz and 4.6 GHz, respectively. The VSWR values at the resonance frequencies f1 and f2 were "2.8" and "1.6", respectively. Thus, there was a large difference between the VSWR values at the resonance frequencies f1 and f2. Moreover, a VSWR value at the maximum frequency fc between the resonance frequencies f1 and f2 was "4.9", which is very high.

Next, at least one slit 4R (not shown in figures) without the capacitive adjustment slit portion 5 and with only the inductive adjustment slit portion 6, was formed. The at least one slit 4R was provided on each of the ground conductor surfaces 21 and 22 of the substrate 2. The two slits 4R and 4R on the respective ground conductor surfaces 21 and 22 were arranged to coincide with each other, as viewed from either of the ground conductor surfaces 21 and 22. The widths (corresponding to a width c in FIG. 8) of each of the slits 4R were set to about 1.5 mm, for example. Since the maximum frequency fc between the resonance frequencies f1 and f2 was 4.06 GHz, the length (corresponding to the length L in FIG. 8) of each of the slits 4R was set to about 9 mm, which is about one eighth of a wavelength at the frequency fc.

Each of the slits 4R was arranged at a distance of about 0.5 mm (corresponding to a distance d in FIG. 8) forward of the open end 36*a* of the radiating electrode plate 33 of the antenna main body 3. Then, as in the above case, a current at a frequency of 3 GHz to 5 GHz was fed to the antenna main body 3, and a VSWR value at each frequency was measured.

As indicated by chain double-dashed line S2 in FIG. 9, VSWR values at the resonance frequencies f1 and f2 were "2.2" and "2.0", respectively. The difference between the VSWR values at the resonance frequencies f1 and f2 was thus reduced. Moreover, a VSWR value at the maximum frequency fc between the resonance frequencies f1 and f2 was "3.6", which is much lower than that in the case where the slits 4R were not provided. However, the VSWR value at the maximum frequency fc was not sufficiently low.

Last, the at least one slit 4 having the capacitive adjustment slit portion 5 and the inductive adjustment slit portion 6 were provided. The at least one slit 4 was provided on each of the ground conductor surfaces 21 and 22. The two slits 4 and 4 were arranged to coincide with each other. As illustrated in FIG. 8, the length L of each of the slits 4 was set to about 9 mm, which is about one eighth of a wavelength at the frequency fc. A width e and a length f of the capacitive adjustment slit portions 5 were set to about 0.2 mm and about 3 mm, respectively. The width c and a length g of the inductive adjustment slit portions 6 were set to about 1.5 mm and about 6 mm, respectively.

Each of the slit 4 was arranged at a distance of about 0.5 mm (corresponding to the distance d in FIG. 8) forward of the open end 36*a* of the radiating electrode plate 33. Then, as in the above case, a current at a frequency of 3 GHz to 5 GHz was fed to the antenna main body 3, and a VSWR value at each frequency was measured.

As indicated by dashed line S3 in FIG. 9, VSWR values at the resonance frequencies f1 and f2 were "2.1" and "2.4", respectively. Moreover, a VSWR value at the maximum frequency fc between the resonance frequencies f1 and f2 was "3.0", which is much lower than that in the case where the slits 4R were provided.

The above experiment showed that, with the at least one slit 4 or plurality of slits 4, it is possible to achieve good VSWR characteristics in which the VSWR values at the resonance frequencies f1 and f2 are substantially the same, and in which the VSWR value at the maximum frequency fc is close to the VSWR values at the resonance frequencies f1 and f2.

Preferred Embodiment 2

Hereinafter, a second preferred embodiment of the present invention will be described.

Figure 10:
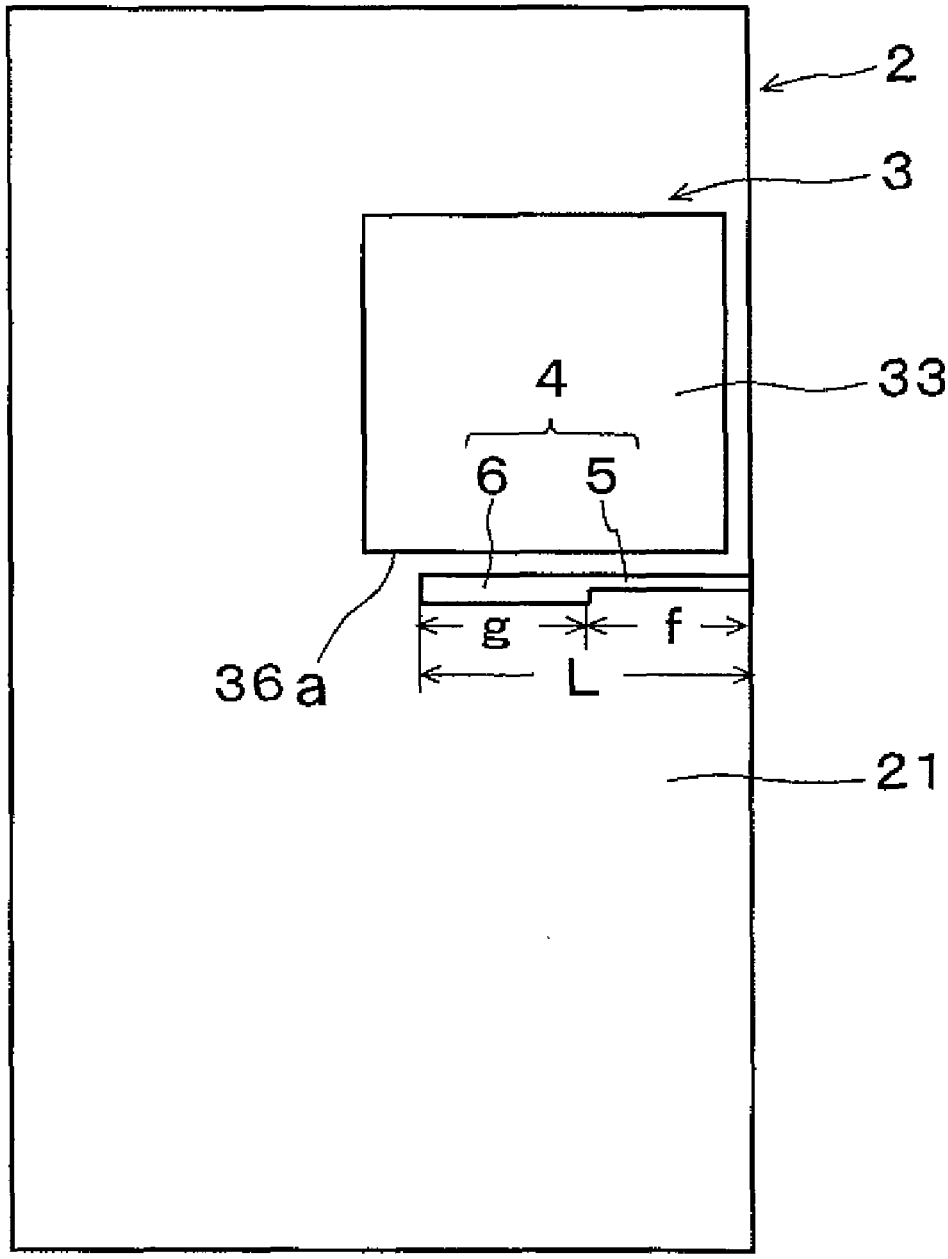
FIG. 10 is a schematic plan view of an antenna device according to a second preferred embodiment of the present invention.

FIG. 10 is a schematic plan view of an antenna device according to the second preferred embodiment of the present invention.

The present preferred embodiment is different from the first preferred embodiment in that the antenna main body 3 is mounted at a location other than a corner of the substrate 2.

Specifically, with the open end 36*a* of the radiating electrode plate 33 of the antenna main body 3 oriented in the longitudinal direction of the substrate 2, the antenna main body 3 is mounted closer to the center of the substrate 2. The at least one slit 4 is provided near the open end 36*a* of the radiating electrode plate 33.

The length L of the at least one slit 4 is preferably set to about one quarter of a wavelength at a frequency that is between two resonance frequencies of the antenna main body 3 and corresponds to the highest VSWR value.

With the structure described above, as in the case of the first preferred embodiment, the highest VSWR value corresponding to a frequency between two resonance frequencies can be reduced to a value close to VSWR values corresponding to the two resonance frequencies.

The present inventor carried out the following experiment to confirm the effect described above.

Figure 11:
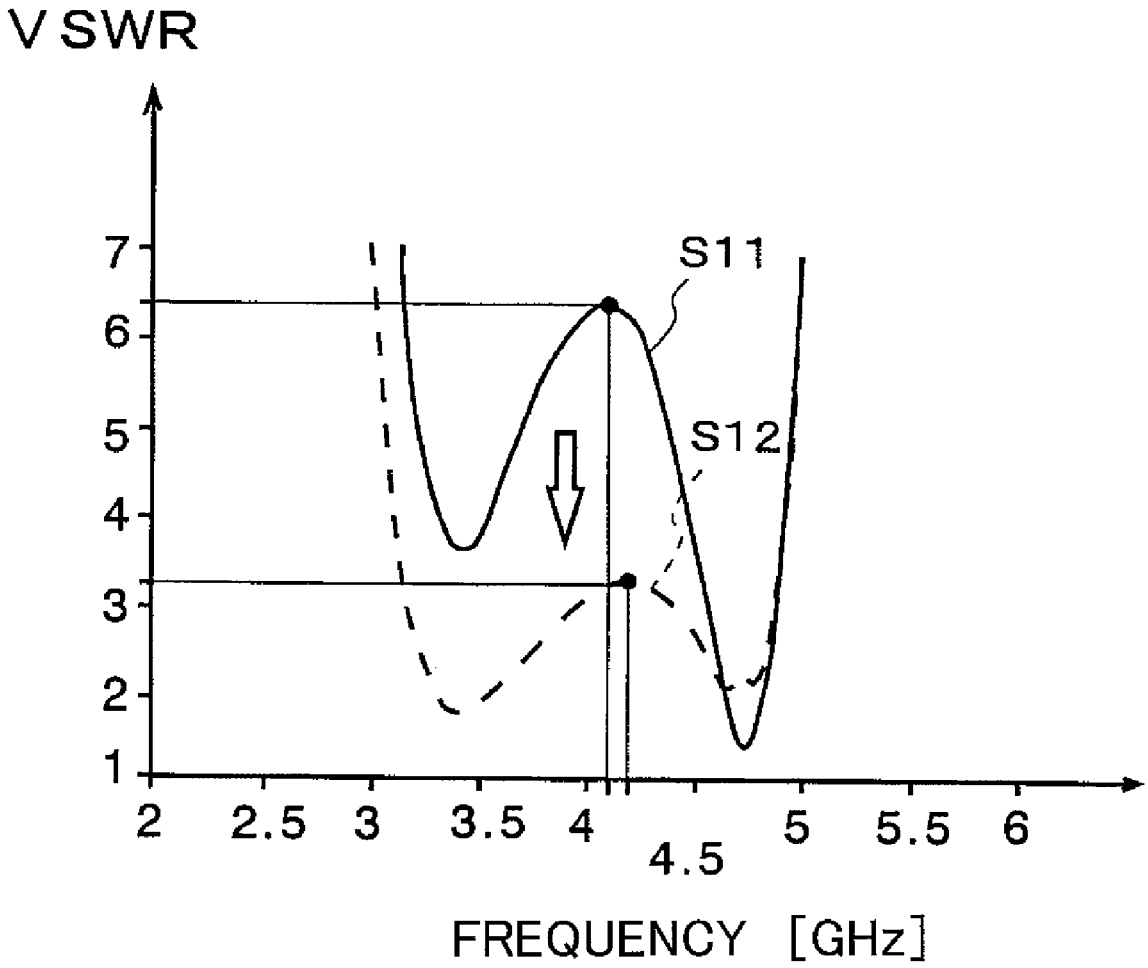
FIG. 11 is a VSWR characteristic diagram showing a result of an experiment.

FIG. 11 is a VSWR characteristic diagram showing a result of the experiment.

In this experiment, the substrate 2 measuring 30 mm wide by 60 mm long was used. The antenna main body 3 equivalent to that used in the first preferred embodiment was mounted closer to the center of the substrate 2.

First, without providing the at least one slit or plurality of slits 4, a current at a frequency of 3 GHz to 5 GHz was fed to the antenna main body 3, and a VSWR value at each frequency was measured. As indicated by solid line S11 in FIG. 11, the resonance frequencies f1 and f2 were 3.3 GHz and 4.7 GHz, respectively. The VSWR values at the resonance frequencies f1 and f2 were "3.7" and "1.4", respectively. Thus, there was a very large difference between the VSWR values at the resonance frequencies f1 and f2. Moreover, a VSWR value at the maximum frequency fc between the resonance frequencies f1 and f2 was "6.4", which is very high.

Next, as in the case of the experiment in the first preferred embodiment, the at least one slit 4 was provided on each of the ground conductor surfaces 21 and 22. The two slits 4 and 4 were arranged to coincide with each other. The length L of each of the slits 4 was set to about 18 mm, which is about one quarter of a wavelength at the frequency fc. The length f of each of the capacitive adjustment slit portions 5 was set to about 3 mm, and the length g of each of the inductive adjustment slit portions 6 was set to about 15 mm.

As in the case of the experiment in the first preferred embodiment, each of the slits 4 was arranged at a distance of about 0.5 mm forward of the open end 36*a* of the radiating electrode plate 33. Then, a current at a frequency of 3 GHz to 5 GHz was fed to the antenna main body 3, and a VSWR value at each frequency was measured.

As indicated by dashed line S12 in FIG. 11, VSWR values at the resonance frequencies f1 and f2 were "1.8" and "2.2", respectively. Thus, there was substantially no difference between the VSWR values at the resonance frequencies f1 and f2. Moreover, a VSWR value at the maximum frequency fc between the resonance frequencies f1 and f2 was "3.2", which is much lower than that in the case where the at least one slit 4 or the plurality of slits 4 were not provided. That is, as in the case of the first preferred embodiment, the above experiment in the second preferred embodiment showed that it is possible to achieve good VSWR characteristics in which the VSWR values at the resonance frequencies f1 and f2 are substantially the same, and in which the VSWR value at the maximum frequency fc is close to the VSWR values at the resonance frequencies f1 and f2.

The other structures, operations, and effects of the second preferred embodiment are the same as those of the first preferred embodiment described above, and thus their description will be omitted.

Preferred Embodiment 3

Next, a third preferred embodiment of the present invention will be described.

Figure 12:
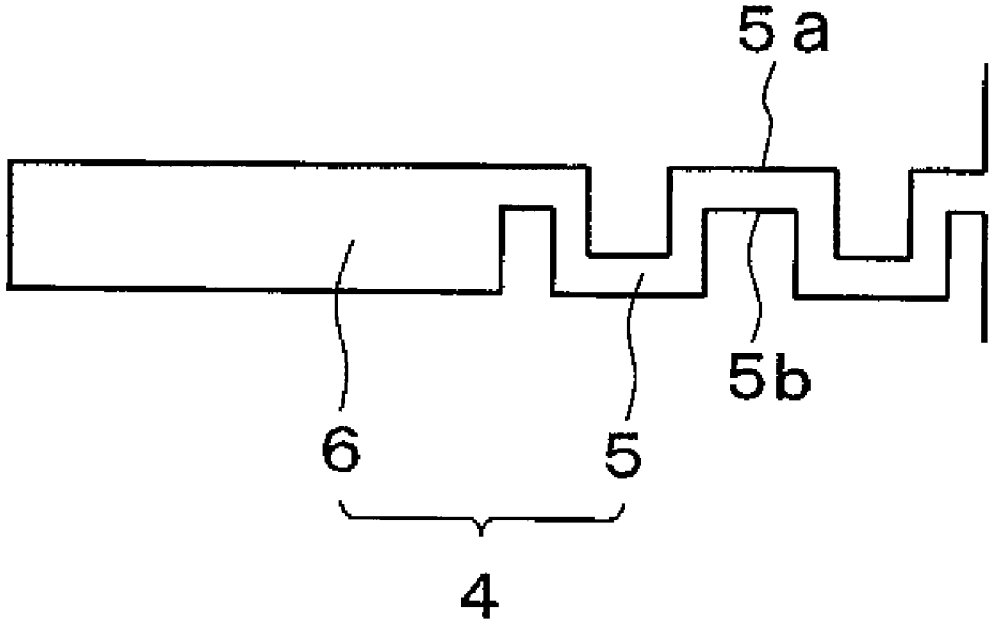
FIG. 12 is a schematic plan view illustrating a main part of an antenna device according to a third preferred embodiment of the present invention.

FIG. 12 is a schematic plan view illustrating a main portion of an antenna device according to the third preferred embodiment of the present invention.

The present preferred embodiment is different from the above-described preferred embodiments in terms of the shape of the capacitive adjustment slit portion 5 of the at least one slit 4.

Specifically, as illustrated in FIG. 12, the inner edges 5*a* and 5*b* of the capacitive adjustment slit portion 5 of the at least one slit 4 each are formed into a shape of comb teeth, such that the inner edges 5*a* and 5*b* engage each other with a predetermined distance therebetween. Thus, the capacitive adjustment slit portion 5 is formed into a meandering shape.

This structure allows the inner edges 5*a* and 5*b*, each having a comb-tooth shape, to face each other. Since this increases the distance of a portion in which the inner edges 5*a* and 5*b* face each other, the capacitance of the capacitive adjustment slit portion 5 is increased accordingly.

The other structures, operations, and effects of the third preferred embodiment are the same as those of the first and second preferred embodiments described above, and thus their description will be omitted.

Preferred Embodiment 4

Hereinafter, a fourth preferred embodiment of the present invention will be described.

Figure 13:
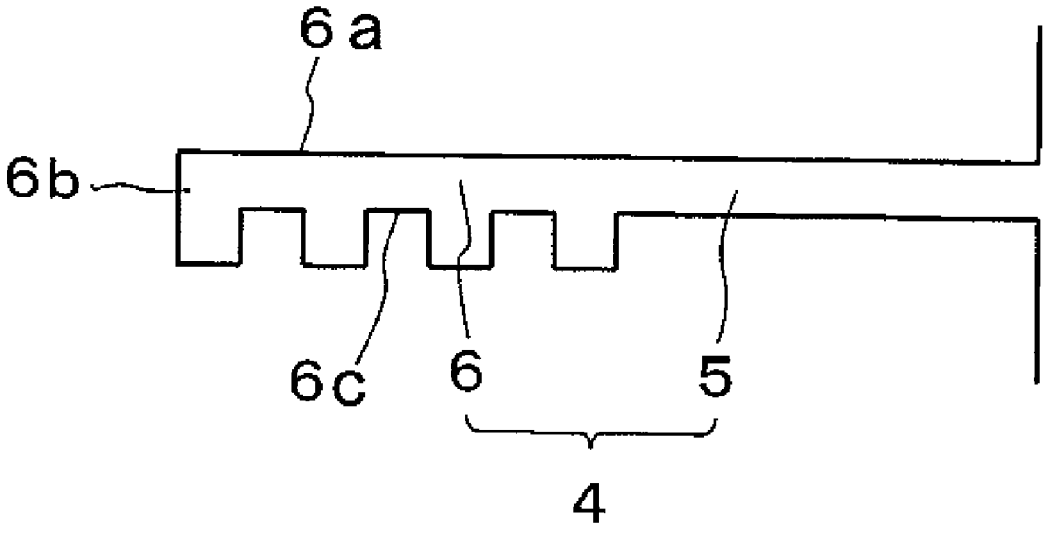
FIG. 13 is a schematic plan view illustrating a main part of an antenna device according to a fourth preferred embodiment of the present invention.

FIG. 13 is a schematic plan view illustrating a main portion of an antenna device according to the fourth preferred embodiment of the present invention.

The present preferred embodiment is different from the above-described preferred embodiments in terms of the shape of the inductive adjustment slit portion 6 of the at least one slit 4.

Specifically, as illustrated in FIG. 13, the inner edge 6*c* of the inductive adjustment slit portion 6 of the at least one slit 4 is bent several times to form the inductive adjustment slit portion 6 into a saw-tooth shape.

This structure increases the distance of the inner edge 6*c* of the inductive adjustment slit portion 6. Since this extends the path of a current flowing along the inner edge 6*c*, the inductance of the inductive adjustment slit portion 6 can be increased accordingly.

Figure 14:
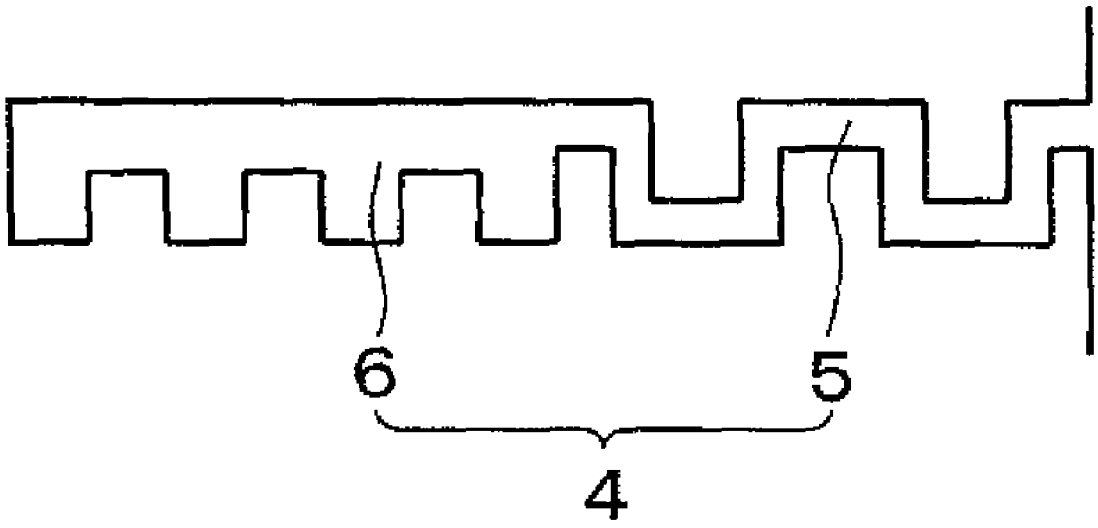
FIG. 14 is a schematic plan view illustrating a modification of the fourth preferred embodiment of the present invention.

In the present preferred embodiment, as illustrated in FIG. 14, the capacitive adjustment slit portion 5 may be formed into a meandering shape.

The other structures, operations, and effects of the fourth preferred embodiment are the same as those of the first and second preferred embodiments described above, and thus their description will be omitted.

Preferred Embodiment 5

Next, a fifth preferred embodiment of the present invention will be described.

Figure 15:
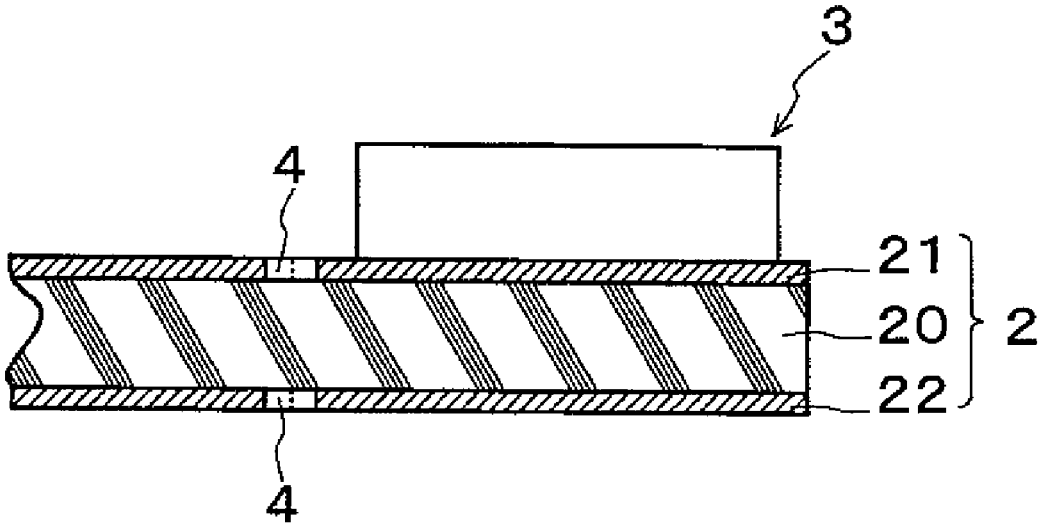
FIG. 15 is a partial cross-sectional view of an antenna device according to a fifth preferred embodiment of the present invention.
Figure 16:
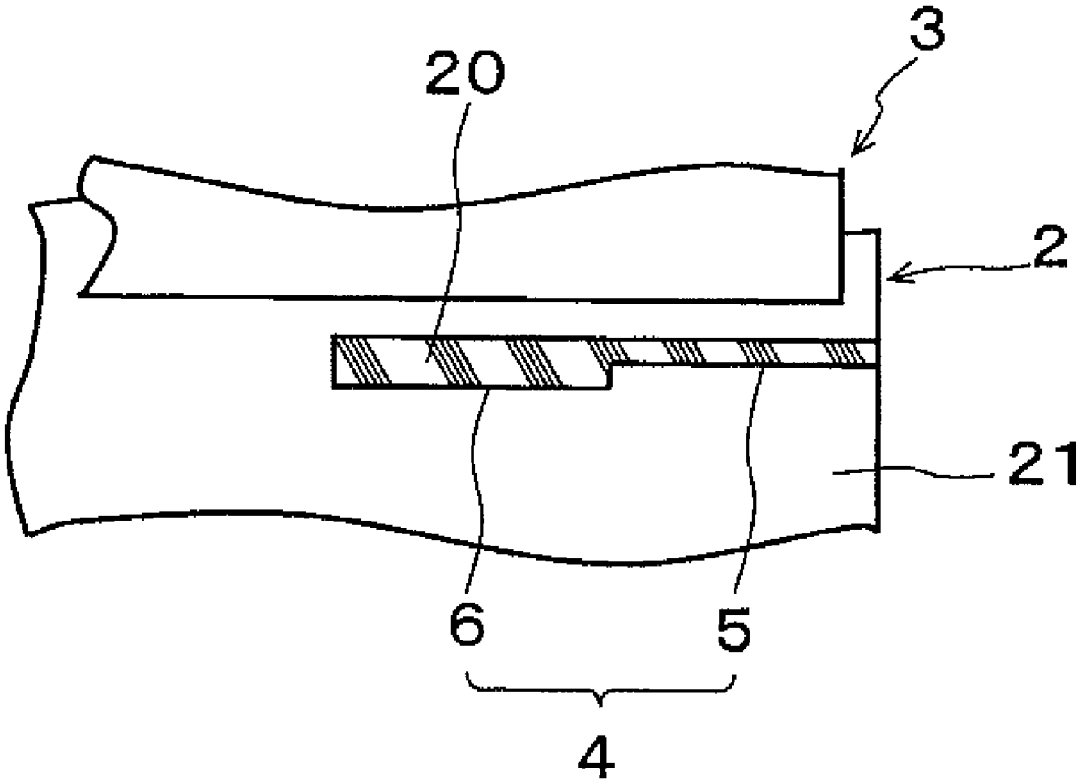
FIG. 16 is a partial enlarged plan view illustrating a main portion of the antenna device according to the fifth preferred embodiment of the present invention.

FIG. 15 is a partial cross-sectional view of an antenna device according to the fifth preferred embodiment of the present invention. FIG. 16 is a partial enlarged plan view illustrating a main portion of the antenna device according to the fifth preferred embodiment.

The present preferred embodiment is different from the above-described preferred embodiments in that a dielectric is disposed inside the at least one slit 4.

Specifically, as illustrated in FIG. 15, a main body 20 of the substrate 2 having the ground conductor surfaces 21 and 22 is made of dielectric material, such as glass epoxy. Thus, as illustrated in FIG. 16, as viewed from above the ground conductor surface 21, the main body 20 of dielectric material is disposed inside the at least one slit 4. Thus, the length of the at least one slit 4 can be reduced.

Figure 17:
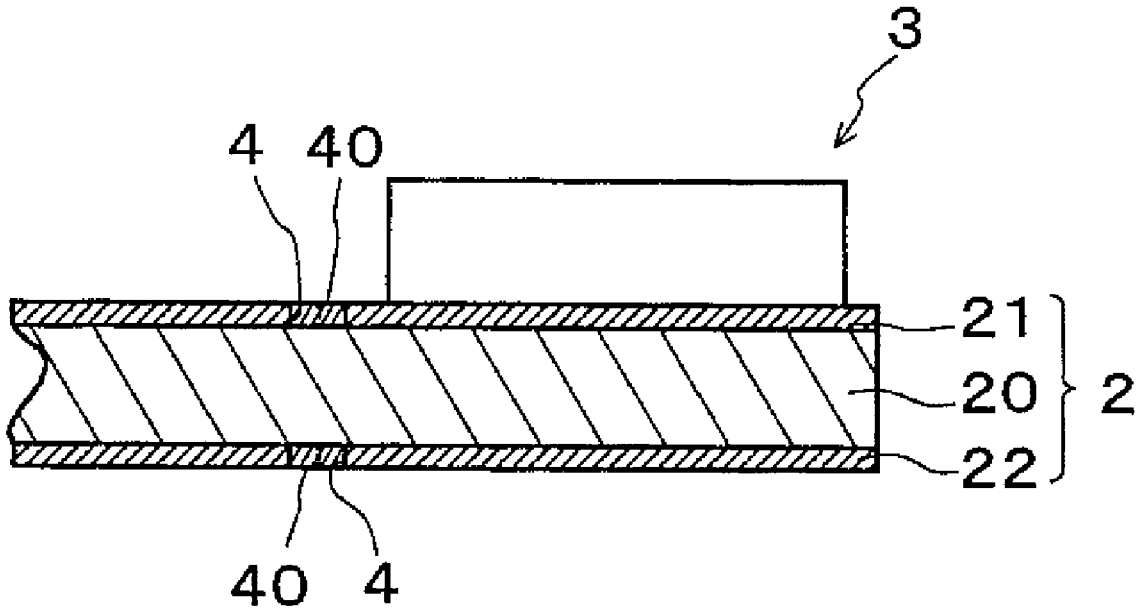
FIG. 17 is a partial cross-sectional view illustrating a modification of the fifth preferred embodiment of the present invention.

Alternatively, as illustrated in FIG. 17, instead of forming the main body 20 of the substrate 2 of dielectric material, the at least one slit 4 may be filled with a dielectric 40.

The other structures, operations, and effects of the fifth preferred embodiment are the same as those of the first to fourth preferred embodiments described above, and thus their description will be omitted.

The present invention is not limited to the preferred embodiments described above, and can be variously modified or changed within the scope of the present invention.

For example, in the foregoing preferred embodiments, the antenna main body 3 having the dielectric base 30, the feeding electrode portion 32, the radiating electrode plate 33, and the short-circuit electrodes 34 and 35 and functioning as a monopole antenna or a patch antenna has been described as an example of an antenna main body. However, the antenna main body may be of any type as long as it is surface-mounted. Therefore, an antenna device having an antenna in which a loop-shaped radiating electrode is formed on a dielectric base, and an antenna device having an inverted-F antenna are also included in the scope of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An antenna device resonating at two different resonance frequencies, comprising:

a substrate having a ground conductor surface; and a surface-mounted antenna main body having a radiating electrode portion disposed above the ground conductor surface of the substrate and a feeding electrode portion extending from the radiating electrode portion and connected to a feeding unit; wherein at least one slit is provided in or near an area where a density of a current induced on the substrate through short-circuit electrodes of the antenna main body on the ground conductor surface and flowing during operation is highest, the at least one slit being arranged perpendicularly or substantially perpendicularly to a direction of the current; and the at least one slit includes a capacitive adjustment slit portion having an open end that is open at an outer edge of the ground conductor surface, and an inductive adjustment slit portion having a first end that is connected to an end of the capacitive adjustment slit portion that is opposite to the open end of the capacitive adjustment slit portion, and a second end that is closed.

2. The antenna device according to claim 1, wherein the radiating electrode portion of the antenna main body includes a radiating electrode plate disposed substantially parallel to the ground conductor surface of the substrate and having an outer edge from which the feeding electrode portion extends, and a plurality of short-circuit electrodes extending from different outer edges of the radiating electrode plate and connected to the ground conductor surface.

3. The antenna device according to claim 2, wherein a pair of the short-circuit electrodes extends from an extending position of the feeding electrode portion along an outer perimeter of the radiating electrode plate and is disposed at opposite positions facing each other, and an end of the radiating electrode plate located opposite the extending position of the feeding electrode portion is an open end.

4. The antenna device according to claim 1, wherein the antenna main body is mounted at a corner of the substrate, with an open end of the radiating electrode plate being oriented in a longitudinal direction of the substrate, the at least one slit is provided near the open end of the radiating electrode plate, and a length of the at least one slit extending from the open end of the capacitive adjustment slit portion to the second end of the inductive adjustment slit portion is about one eighth of a wavelength at or near a frequency corresponding to the highest voltage standing wave ratio, the frequency being between the two resonance frequencies of the antenna main body.

5. The antenna device according to claim 1, wherein the antenna main body is mounted at a location other than a corner of the substrate, with an open end of the radiating electrode plate being oriented in a longitudinal direction of the substrate, the at least one slit is provided near the open end of the radiating electrode plate, a length of the at least one slit extending from the open end of the capacitive adjustment slit portion to the second end of the inductive adjustment slit portion is about one quarter of a wavelength at or near a frequency corresponding to the highest voltage standing wave ratio, the frequency being between the two resonance frequencies of the antenna main body.

6. The antenna device according to claim 1, wherein a dielectric is disposed inside the at least one slit.

7. The antenna device according to claim 1, wherein the capacitive adjustment slit portion has a meandering shape.

8. The antenna device according to claim 1, wherein the inductive adjustment slit portion has a saw-tooth shape.

9. The antenna device according to claim 1, further comprising a plurality of slits in or near the area where the density of a current induced on the substrate through short-circuit electrodes of the antenna main body on the ground conductor surface and flowing during operation is highest, and the plurality of slits are arranged perpendicularly or substantially perpendicularly to the direction of the current.

10. A wireless communication apparatus comprising the antenna device according to claim 1.

* * * * *